US012405026B2

(12) United States Patent
Carroll

(10) Patent No.: US 12,405,026 B2
(45) Date of Patent: Sep. 2, 2025

(54) DROP IN FLUSH MOUNT REGISTER SYSTEM WITH SLIDABLE DAMPER

(71) Applicant: DECOR GRATES INCORPORATED, Ajax (CA)

(72) Inventor: Owen Carroll, Ajax (CA)

(73) Assignee: DECOR GRATES INCORPORATED, Ajax (CA)

( * ) Notice: Subject to any disclaimer, the term of this patent is extended or adjusted under 35 U.S.C. 154(b) by 238 days.

(21) Appl. No.: 18/226,209

(22) Filed: Jul. 25, 2023

(65) Prior Publication Data

US 2023/0366585 A1 Nov. 16, 2023

Related U.S. Application Data

(63) Continuation-in-part of application No. 17/127,602, filed on Dec. 18, 2020, now Pat. No. 11,879,662, which is a continuation-in-part of application No. 16/290,499, filed on Mar. 1, 2019, now Pat. No. 11,460,216.

(60) Provisional application No. 62/637,694, filed on Mar. 2, 2018.

(51) Int. Cl.

| | |
|---|---|
| ***F24F 13/00*** | (2006.01) |
| ***F24F 13/08*** | (2006.01) |
| ***F24F 13/15*** | (2006.01) |

(52) U.S. Cl.

CPC ..... *F24F 13/084* (2013.01); *F24F 13/15* (2013.01)

(58) Field of Classification Search

CPC ..... F24F 13/1426; F24F 13/1413; F24F 2013/1473; F24F 13/068; F24F 13/082

USPC ..... 454/290, 330–332

See application file for complete search history.

(56) References Cited

U.S. PATENT DOCUMENTS

| | | | |
|---|---|---|---|
| 770,326 | A | 9/1904 | Slater |
| 4,625,632 | A | 12/1986 | Markman et al. |
| 5,058,490 | A | 10/1991 | Sodec et al. |
| 5,551,915 | A | 9/1996 | Schweikert |
| 5,984,776 | A | 11/1999 | Berger |
| 6,234,894 | B1 | 5/2001 | Goracke et al. |
| 6,503,140 | B1 | 1/2003 | Haynes |
| 8,882,572 | B2 | 11/2014 | McReynolds et al. |
| 9,028,309 | B2 | 5/2015 | Rimmer |
| 10,704,800 | B2 | 7/2020 | Pridemore et al. |
| 2003/0139133 | A1 | 7/2003 | Hardy |
| 2003/0220068 | A1 | 11/2003 | Orendorff |
| 2003/0220069 | A1 | 11/2003 | Orendorff |
| 2006/0079171 | A1 | 4/2006 | Lu |
| 2011/0034120 | A1 | 2/2011 | Jaiyeola |
| 2013/0072104 | A1 | 3/2013 | Picco et al. |
| 2016/0290661 | A1 | 10/2016 | Ogura |
| 2019/0128558 | A1 | 5/2019 | Mantenuto |
| 2019/0137138 | A1 | 5/2019 | Uddin Syed |

FOREIGN PATENT DOCUMENTS

| | | | |
|---|---|---|---|
| WO | 2017214697 | A1 | 12/2017 |

*Primary Examiner* — Ko-Wei Lin

(74) *Attorney, Agent, or Firm* — Resolute Legal PLLC

(57) ABSTRACT

A flush mount register system comprising: a register; a damper box; a substrate tray nested within the register via a plurality of struts; and having a continuous peripheral gap defined between the substrate tray and the register; a damper slidably mounted on the damper box for controlling air flow volume through the damper box into the continuous peripheral gap; wherein the substrate tray receives a substrate, and wherein the register rests on the damper box.

20 Claims, 15 Drawing Sheets

14

90

DROP IN FLUSH MOUNT REGISTER SYSTEM WITH SLIDABLE DAMPER

CROSS REFERENCE TO RELATED APPLICATIONS

This application is a continuation-in-part of U.S. patent application Ser. No. 17/127,602, filed Dec. 18, 2020, which is a continuation in part application of U.S. patent application Ser. No. 16/290,499, filed Mar. 1, 2019, which claims priority to U.S. Provisional Application Ser. No. 62/637,694 filed on Mar. 2, 2018, whose entire disclosures are hereby incorporated by reference.

FIELD

The present disclosure relates to ventilation heating and cooling systems, and more particularly it relates to flush mount air registers.

BACKGROUND

In forced air heating and cooling systems a fan associated with a furnace forces air through a duct system to distribute heated air or conditioned air throughout a building. Air emerges from outlets in the duct system, and the outlets generally include registers operable to regulate the flow of air. For registers which are situated in a floor, a grill is typically placed over the vent opening to provide an aesthetically pleasing appearance to the outlet. Normally, when installing flooring it is often desirable to include a register grill that also matches the flooring in order to give the flooring a homogeneous look. However, most flooring manufacturers and home improvement stores only have limited types and styles of register grills available, and end users are often forced to find the closest match to the flooring, and make do with their choice. Even if one was to consider custom manufacturing a limited number of register grills for a particular flooring, such a process may be impractical, expensive, and time consuming, as most manufacturers require minimum volumes to justify the cost of specialized tooling and dedicated personnel. In addition, given that there may be variations in flooring from batch to batch due to the nature of wood or tile, such matching may be difficult to achieve leading to inconsistencies in the overall flooring appearance.

SUMMARY

In one aspect, a flush mount register system comprising:
a register;
a damper box;
a substrate tray nested within the register via a plurality of struts; and
having a continuous peripheral gap defined between the substrate tray and the register;
a damper slidably mounted on the damper box for controlling air flow volume through the damper box into the continuous peripheral gap;
wherein the substrate tray receives a substrate, and
wherein the register rests on the damper box.
In one aspect, a flush mount register system comprising:
a register;
a damper box comprising a top opening, a bottom opening and an apertured bottom wall adjacent to the bottom opening, and wherein the register rests on the damper box;

a substrate tray nested within the register, and having a continuous peripheral gap defined between the substrate tray and the register, and
wherein the substrate tray receives a substrate;
a damper slidably mounted on the damper box for controlling air flow volume through the damper box into the continuous peripheral gap;
an apertured grid removably attached to the bottom opening of the damper box, such that a cavity is defined between the apertured grid and the bottom opening; and
an air filter retained within the cavity.
Advantageously, the system comprises a damper box and substrate tray, which are both flush with the flooring, and can be used for flooring with various thicknesses e.g. 0.375 inches to 0.75 inches.
In addition, the system can be customized for installation in flooring with various floor thicknesses, by simply adjusting the height of the flooring substrate frame such that flooring substrate frame, and tray with flooring substrate are flush with the rest of the flooring. Accordingly, there is no need multiple stock keeping units (SKUs) for each floor thickness or vent opening.
Furthermore, the system allows any flooring system to be matched regardless of the flooring material. For example, the flooring material may be wood, laminate, carpet, engineered products, tile, carpet and vinyl.

DETAILED DESCRIPTION

The detailed description of exemplary embodiments herein makes reference to the accompanying block diagrams and schematic diagrams, which show the exemplary embodiment by way of illustration. While these exemplary embodiments are described in sufficient detail to enable those skilled in the art to practice the invention, it should be understood that other embodiments may be realized and that logical and mechanical changes may be made. Thus, the detailed description herein is presented for purposes of illustration only and not of limitation. For example, the steps recited in any of the method or process descriptions may be executed in any order and are not limited to the order presented.

Moreover, it should be appreciated that the particular implementations shown and described herein are illustrative of the invention and its best mode and are not intended to otherwise limit the scope of the present invention in any way. Indeed, for the sake of brevity, certain sub-components of the individual operating components.

Figure 1:
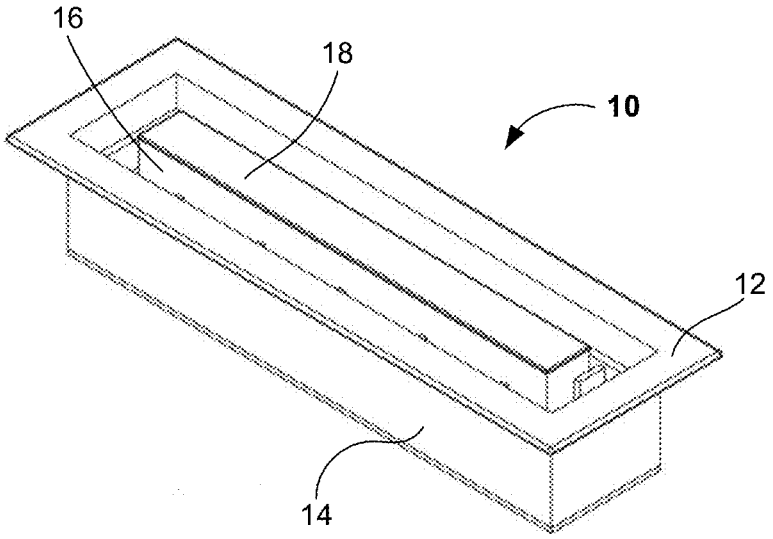
FIG. 1 shows a perspective view of a flush mount register system.
Figure 2:
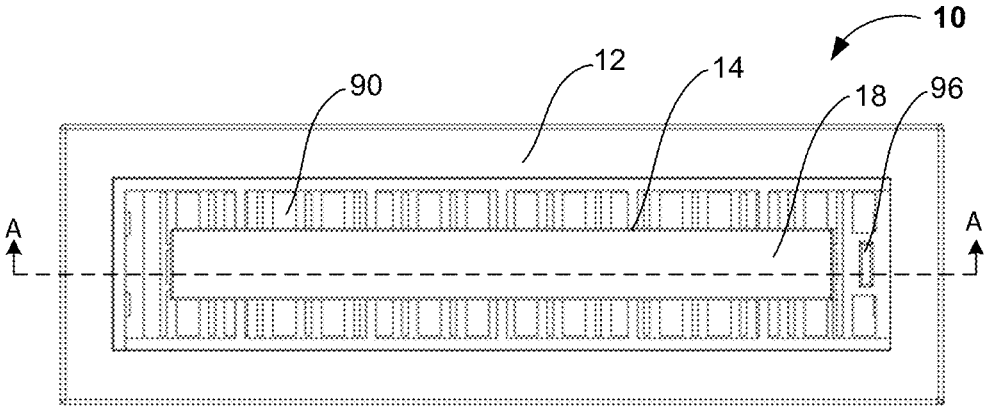
FIG. 2 shows a top view of the flush mount register system.
Figure 3:
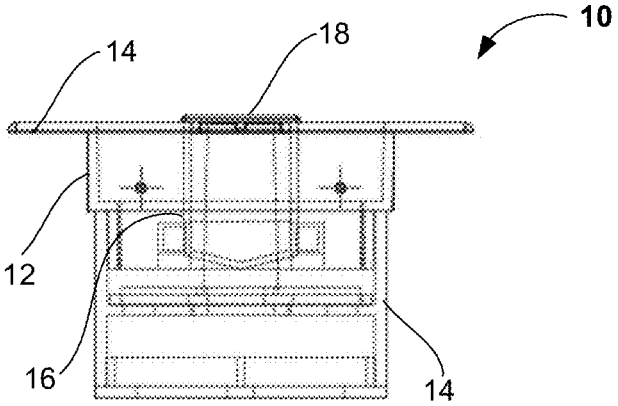
FIG. 3 shows a sectional view of the flush mount register system.

Looking at FIGS. 1-3 there is shown a flush mount register system 10 for installation in an opening of a surface, such as a floor, ceiling, or wall. In one example, the surface may be covered by a material, such as wood, laminate, composite, plastic, tile, or drywall. The opening is in fluid communication with duct coupled to a heating, ventilation, and air conditioning (HVAC) system. Generally, flush mount register system 10 comprises register 12, damper box 14 and a substrate tray 16 which receives a substrate 18, such as a flooring substrate. Preferably, the substrate 18 that is identical to the surface in which the flush mount register system is mounted, which leads to a more desirable aesthetic look.

Figure 4:
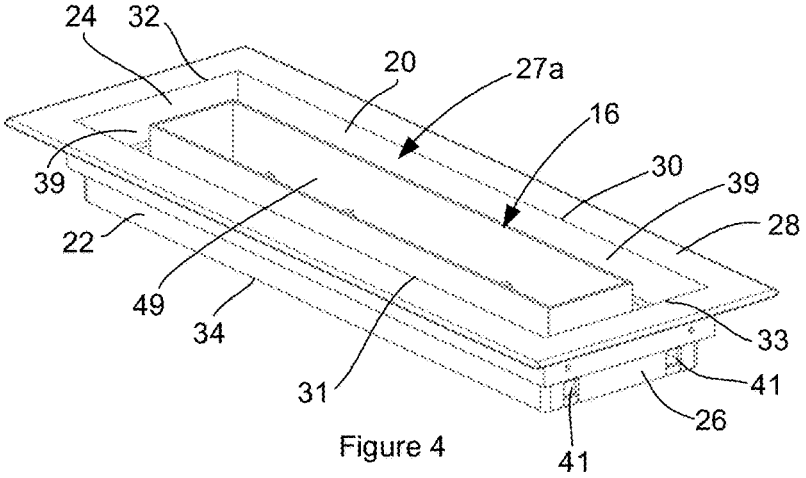
FIG. 4 shows a perspective view of a register.
Figure 5:
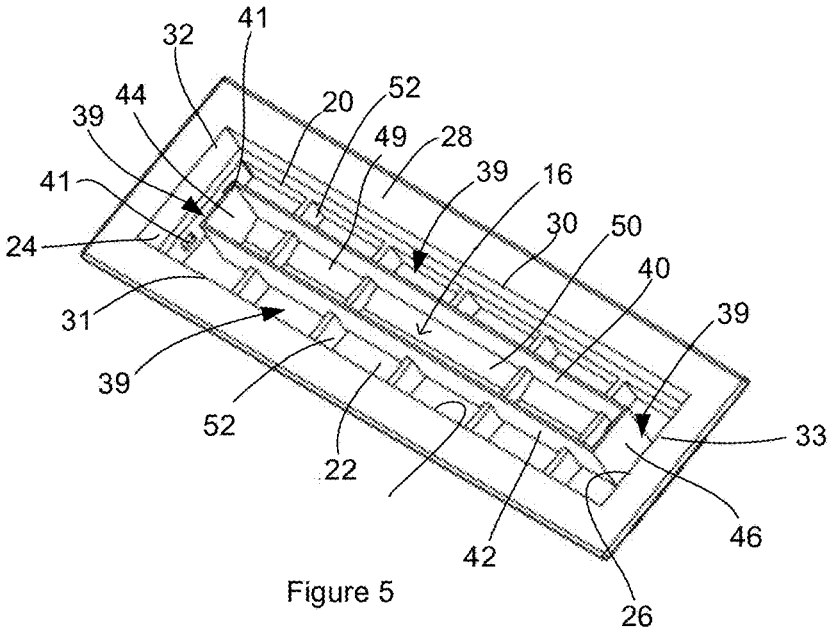
FIG. 5 shows a top perspective view of the register.
Figure 6:
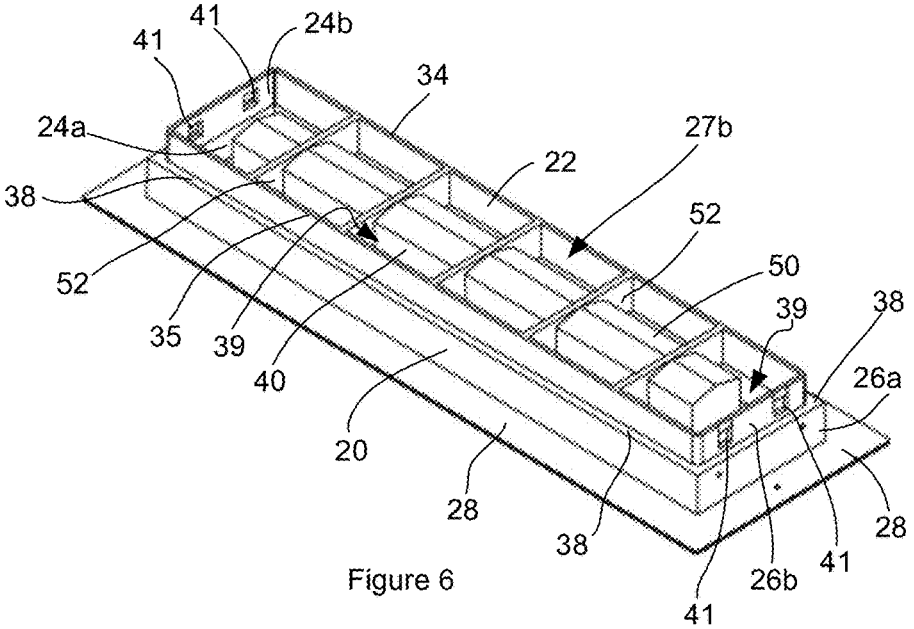
FIG. 6 shows a bottom perspective view of the register.

Now referring to FIGS. 4-6, register 12 comprises first pair of longitudinally extending sidewalls 20, 22 and first pair of laterally extending sidewalls 24, 26, which are joined to form a rectangularly shaped structure with top opening 27*a* and bottom opening 27*b*. Longitudinally extending walls 20, 22 and laterally extending sidewalls 24, 26 comprise rectangular flange 28 extending outwardly and orthogonally from top edges 30, 31 of longitudinally extending walls 20, 22, and extending outwardly and orthogonally from top edges 32, 33 of first pair of laterally extending sidewalls 24, 26. Bottom edges 34, 35 of first pair of longitudinally extending sidewalls 20, 22 and bottom edges 36, 37 of first pair of laterally extending sidewalls 24, 26, define bottom opening 27*b*. The first pair of laterally extending sidewalls 24, 26 comprises two portions 24*a*, 24*b* and 26*a*, 26*b*, respectively, with a shoulder 38 defined between two portions 24*a*, 24*b* and 26*a*, 26*b*, respectively. Substrate tray 16 is disposed between top opening 27*a* and bottom opening 27*b*, and is dimensioned such that a continuous peripheral gap 39 is defined between the substrate tray 16 walls and longitudinally extending walls 20, 22 and laterally extending sidewalls 24, 26 of register 12. Portions 24*b*, 26*b* of first pair of laterally extending sidewalls 24, 26, respectively, include one or more crevices 41 which engage tabs 82 on the damper box 14, as will be described below with reference to FIG. 8.

As can be seen in FIGS. 5 and 6, substrate tray 16 comprises second longitudinally extending walls 40, 42 and laterally extending walls 44, 46, joined together to form a rectangularly shaped structure, with top opening 48 and base 50. Struts 52 extend between the second longitudinally extending walls 40, 42 and the first pair of longitudinally extending sidewalls 20, 22 of the register and maintain the substrate tray 16 within the register 12 with the gap 39 therebetween. Air from the duct is forced through the gap 39 into the space. The base 50 of substrate tray 16 comprises air deflector 60 for directing air towards gap 39, thereby increasing air flow through gap 39.

Figure 7:
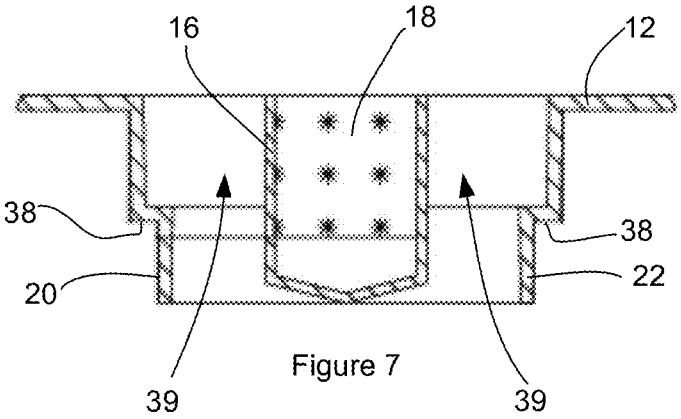
FIG. 7 shows another sectional view of the flush mount register system.

Looking at FIG. 7, flooring substrate 18 is dimensioned to fit within substrate tray 16, such that substrate tray 16 is flush with flooring 12. The depth of substrate tray 16 may be adjusted, or may be varied to allow for full customization of flush mount register system 10 to match the various thicknesses of flooring 12. Accordingly, flush mount register system 10 can be easily installed, without having to level any other component of flush mount register system 10.

Figure 8:
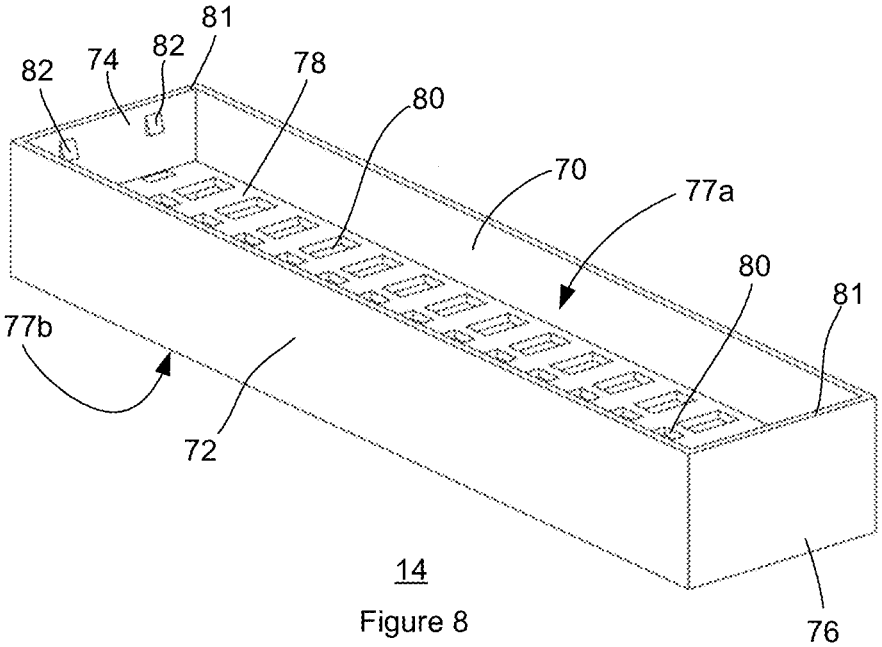
FIG. 8 shows a perspective view of a damper box.

Now referring to FIG. 8, damper box 14 comprises third pair of longitudinally extending sidewalls 70, 72 and third pair of laterally extending sidewalls 74, 76, which are joined to form a rectangularly shaped structure with top opening 77*a* and bottom opening 77*b*. Located between the top opening 77*a* and the bottom opening 77*b* is a bottom wall 78 with a plurality of apertures 80 that are spaced apart by a predefined distance to allow for air to pass through from the duct into the damper box 14. Third pair of longitudinally extending sidewalls 70, 72 and third pair of laterally extending sidewalls 74, 76 comprise an edge 81. Third pair of laterally extending sidewalls 74, 76 further comprise one or more tabs 82. The register 12 is placed on the damper box 14 such that the edges 81 rest on shoulder 38, and the tabs 82 are caused to engage one or more crevices 41 of the register 12 to removably attach the damper box 14 to the register 12.

Figure 9:
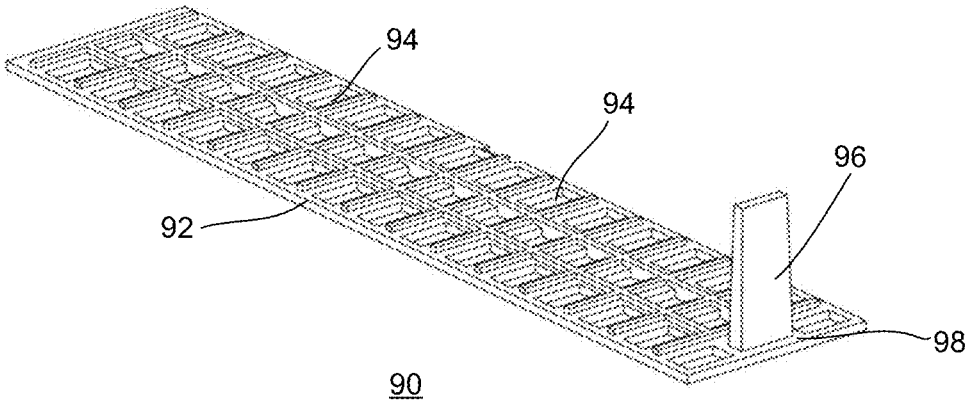
FIG. 9 shows a perspective view of a damper.

A damper 90 is slidably mounted within the damper box 14, and rests on the apertured bottom wall 78 adjacent to the damper box bottom opening 77*b*, for controlling air flow into the damper box 14. As can be seen in FIG. 9, the damper 90 comprises a sliding plate 92 with a plurality of apertures 94 that are spaced apart by a predefined distance, and is configured to move in one direction within the damper box 14 such that the plurality of apertures 94 are aligned, partially aligned, or misaligned with the plurality of apertures 80 of the damper box 14 to allow regulate air flow into the damper 14. The damper 90 comprises a finger 96 projecting from a top surface 98, the finger 96 being located between wall 46 of the substrate tray 16 and wall 76 of the damper box 14. The finger 96 is dimensioned such that it is graspable by a user, such that the user can apply a force to cause the damper 14 to linearly slide relative to the bottom wall 78 of the damper box 14. Accordingly, as the sliding plate 92 slides linearly back and forth relative to the apertured bottom wall 78, the apertures 80, 94 align to form airflow passages of a variable size, thereby regulating the airflow into the damper box 14. As such, when the apertures 80, 94 are fully aligned then maximum air flow into the damper box 14 may be achieved, whereas when the apertures 80, 94 are fully misaligned then air flow into the damper box 14 is substantially impeded or blocked. In one example, the apertures 80 in the bottom 78 and the apertures 94 of the sliding plate 92 are substantially rectangular-shaped, however the apertures 94 may be formed to have shapes other than rectangular.

Figure 10:
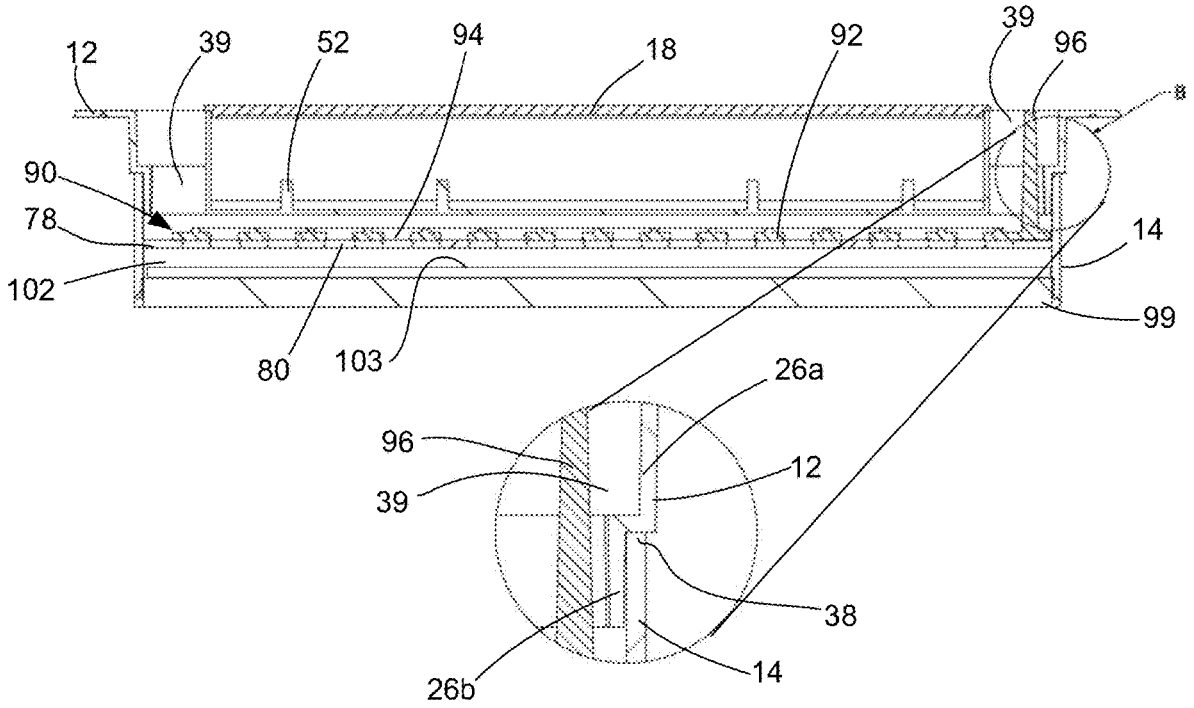
FIG. 10 shows a sectional view of the flush mount register system, taken along line A-A in FIG. 2.
Figure 11:
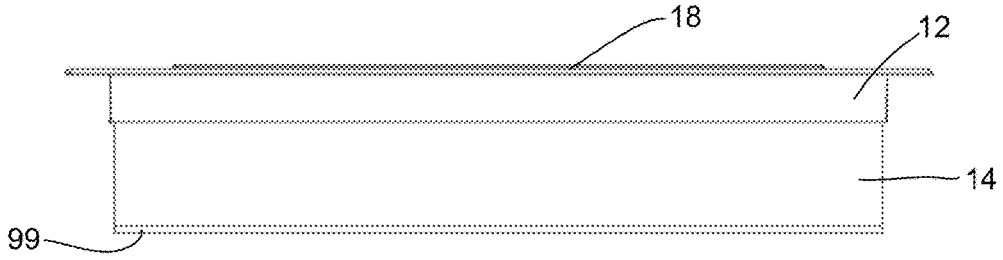
FIG. 11 shows a side view of the register.
Figure 12:
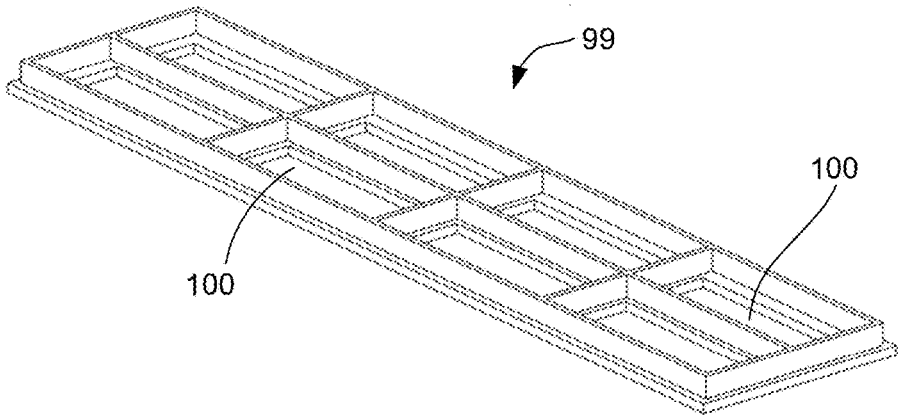
FIG. 12 shows a perspective view of a grid.
Figure 13:
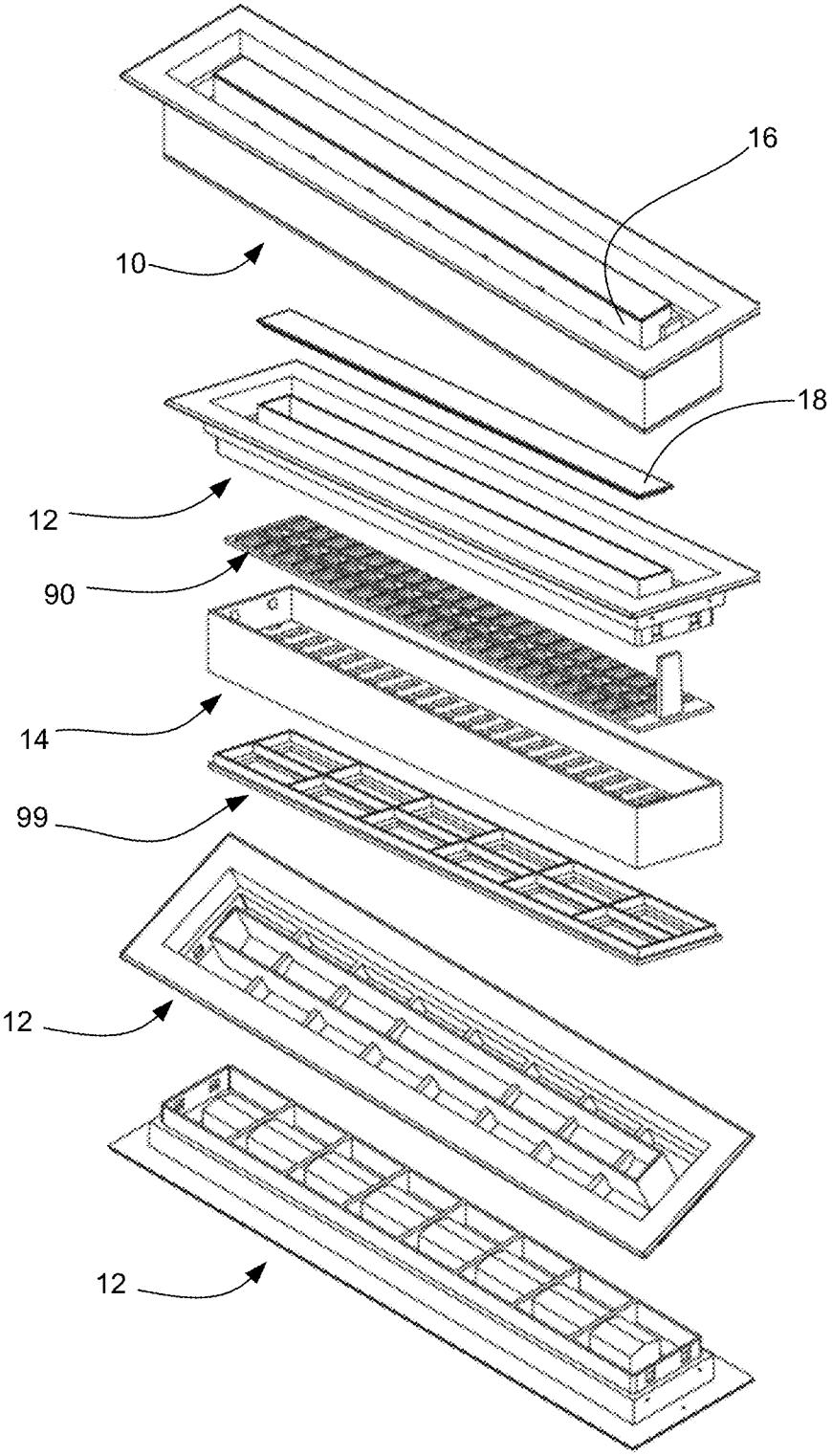
FIGS. 13-23 show different views of the flush mount register system, with various dimensions.
Figure 14:
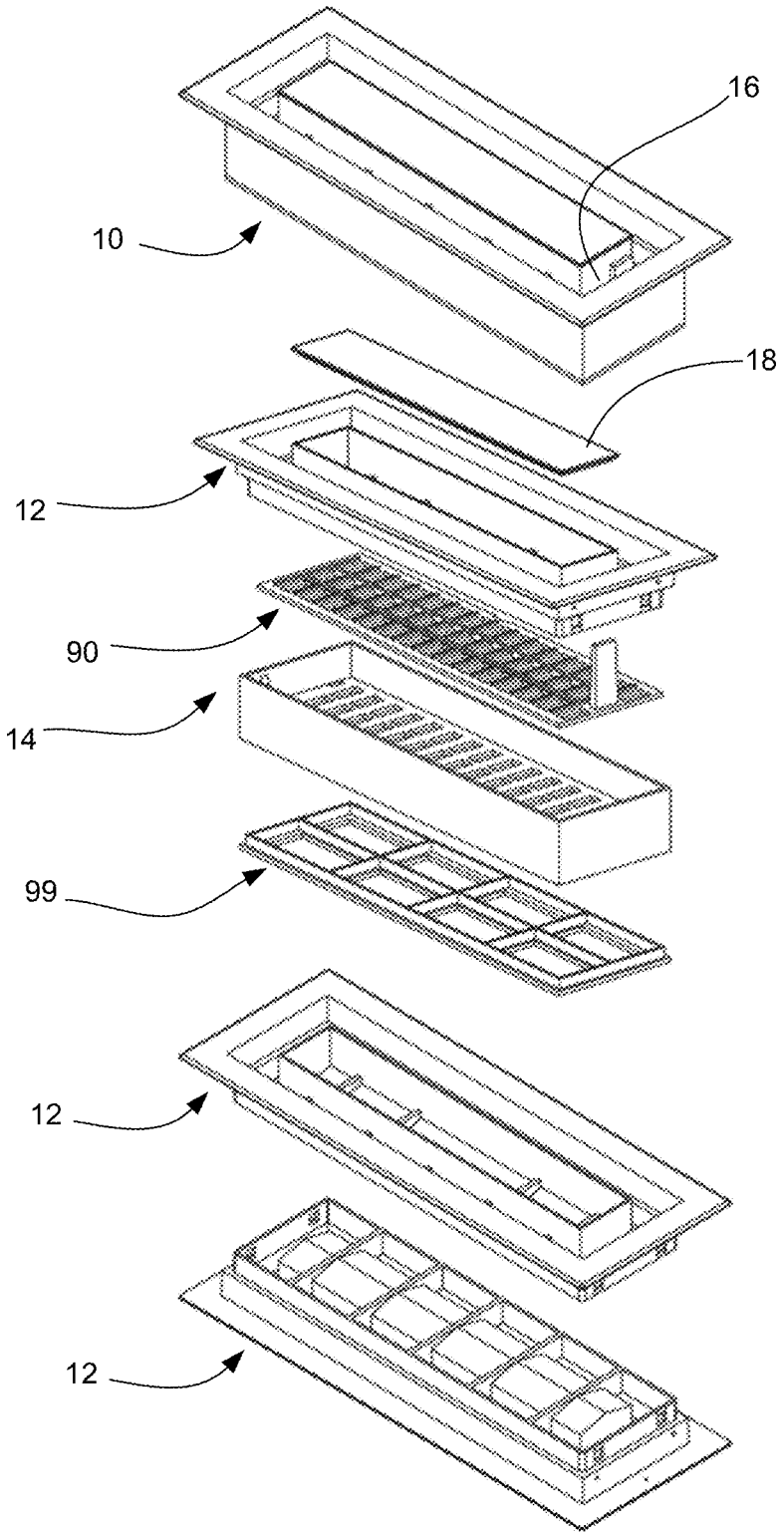
Figure 15:
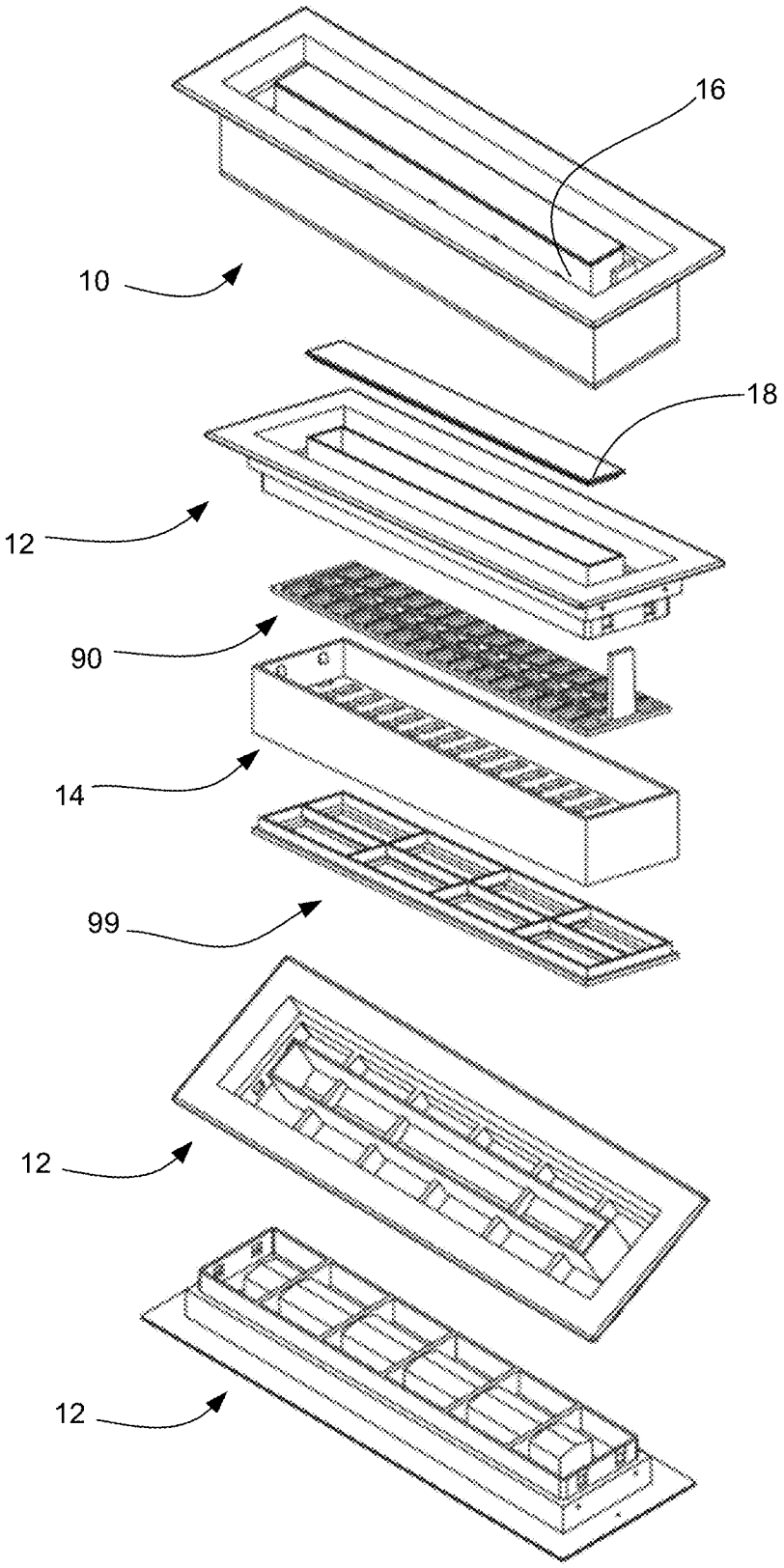
Figure 16:
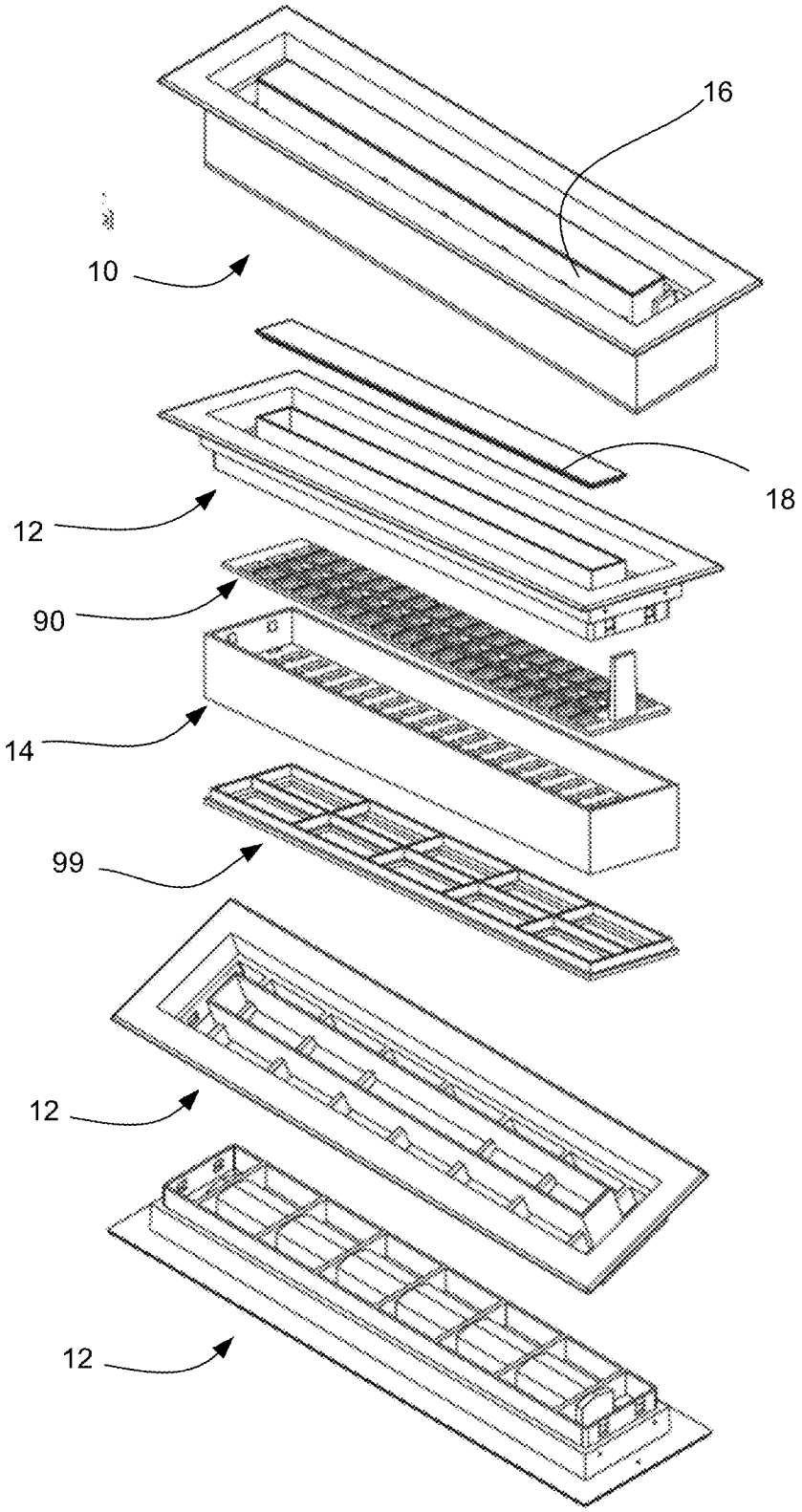
Figure 17:
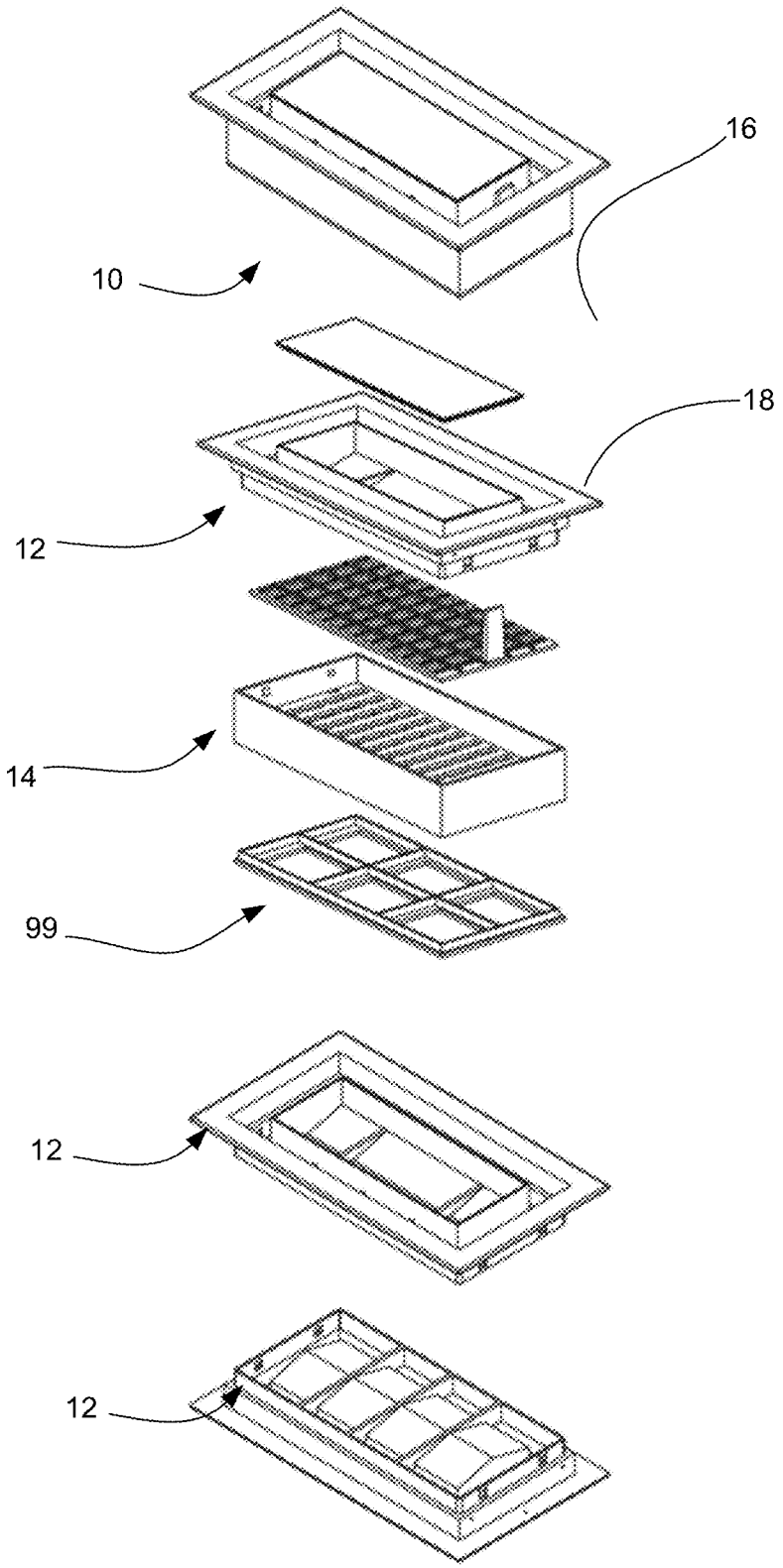
Figure 18:
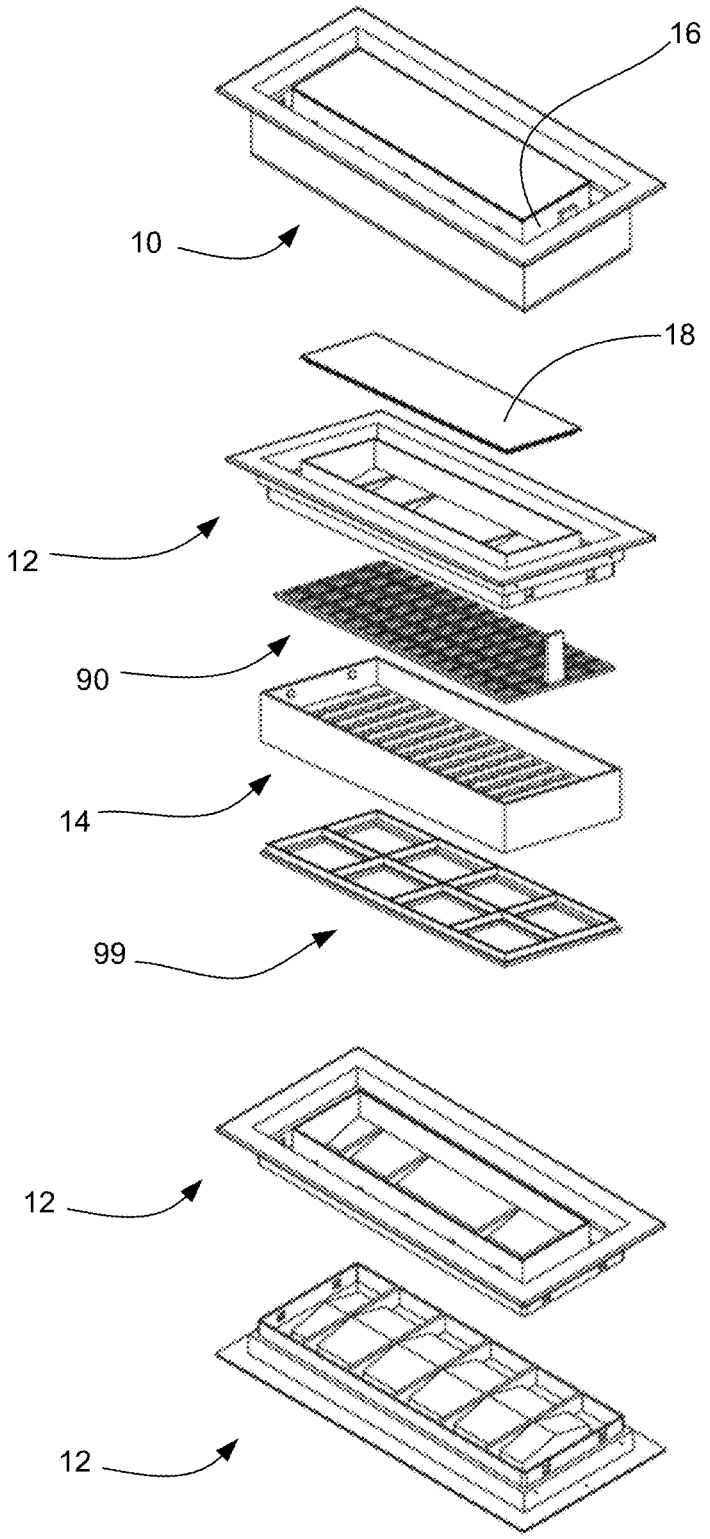
Figure 19:
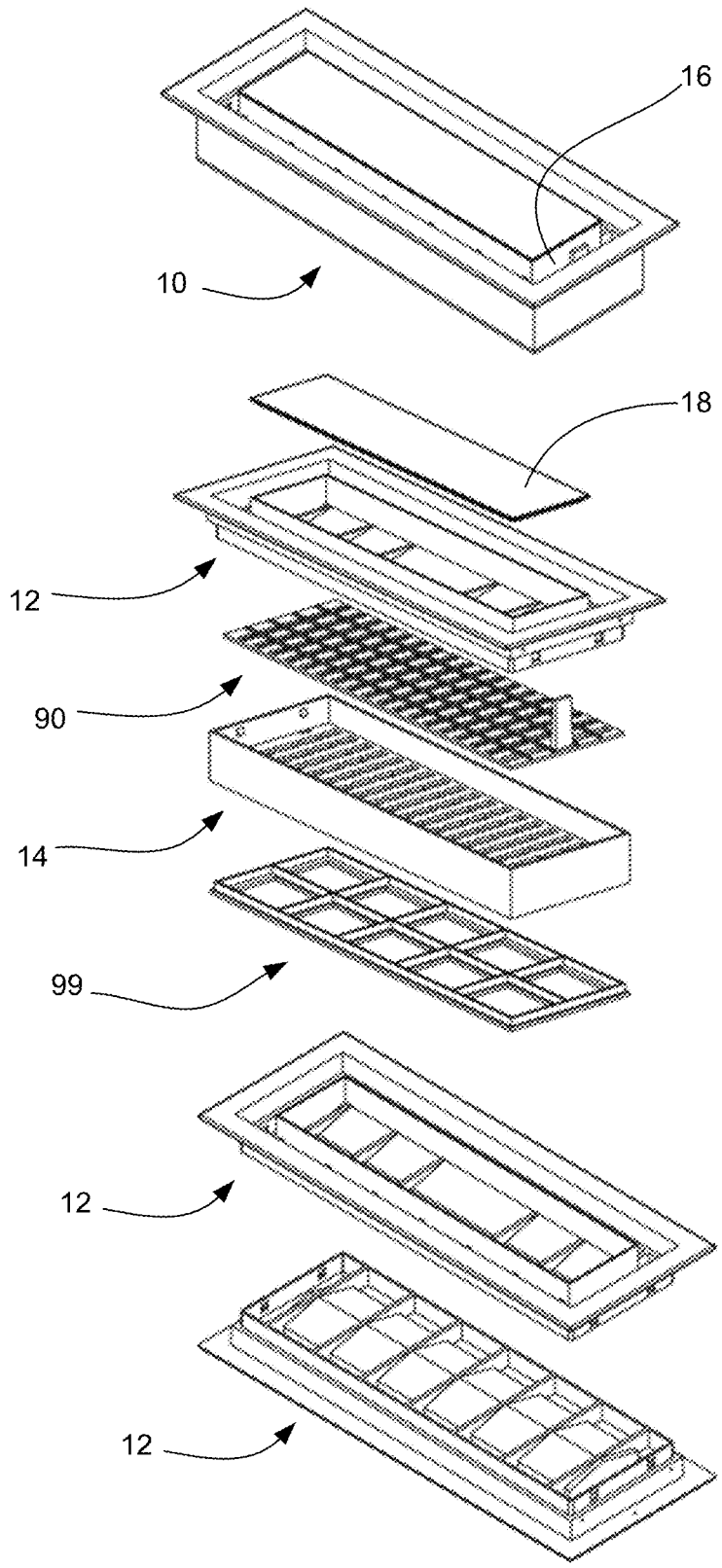
Figure 20:
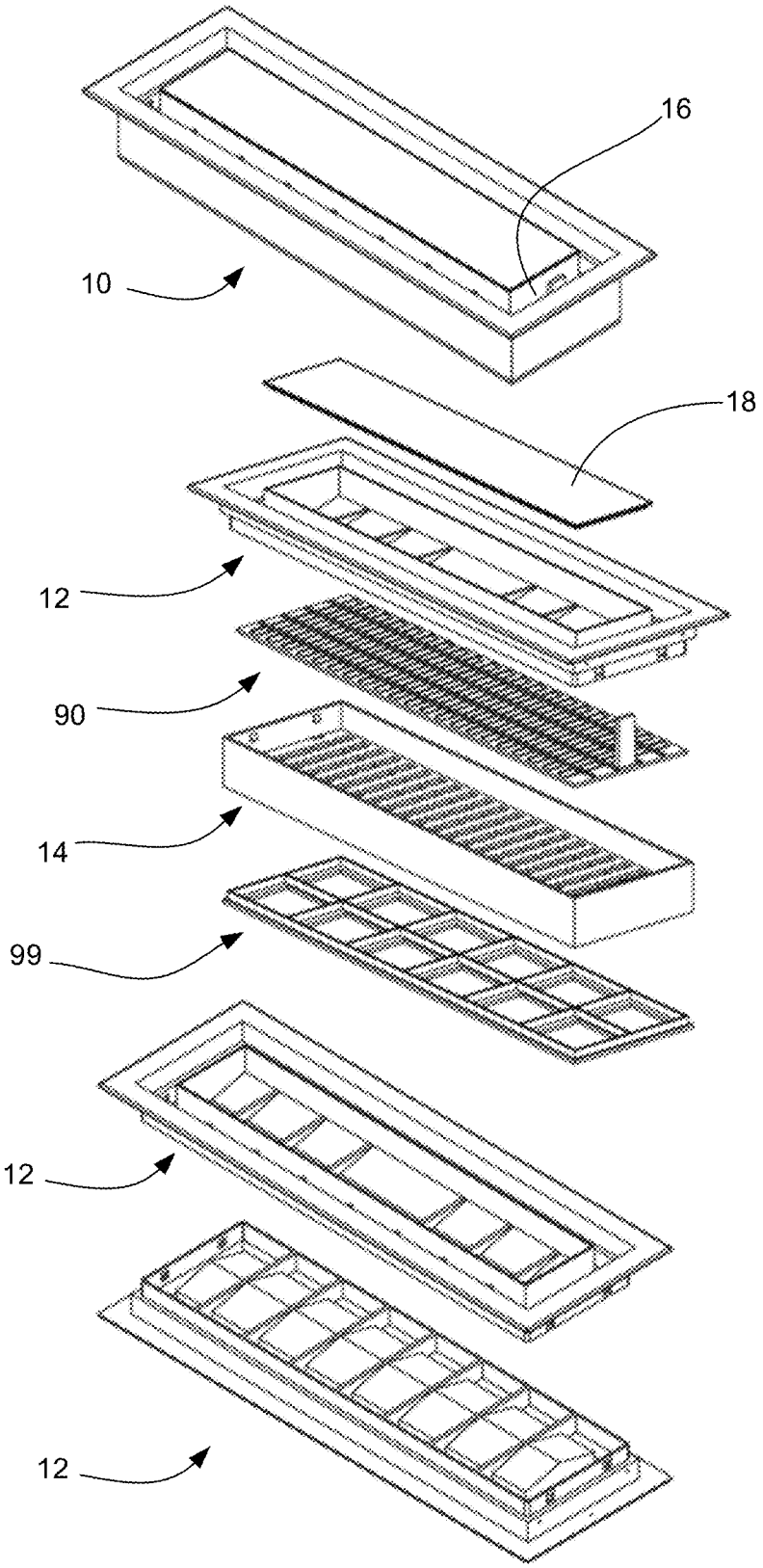
Figure 21:
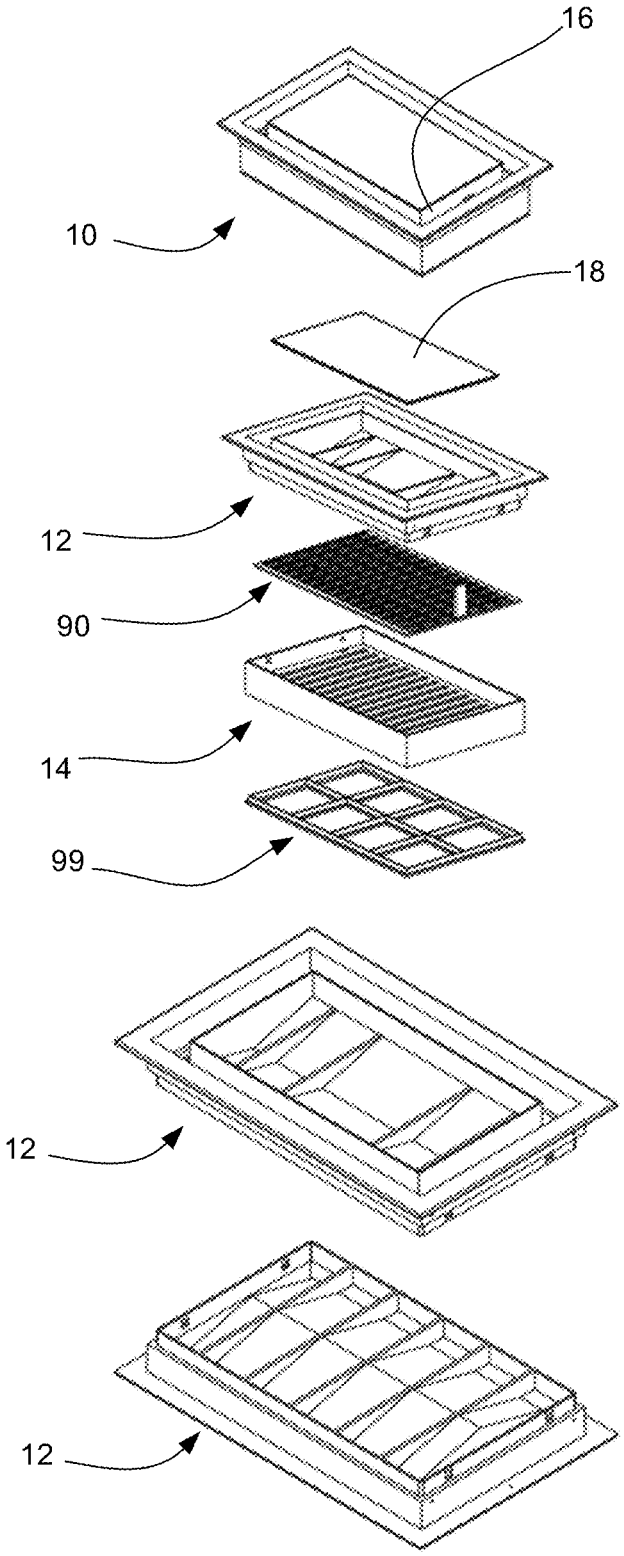
Figure 22:
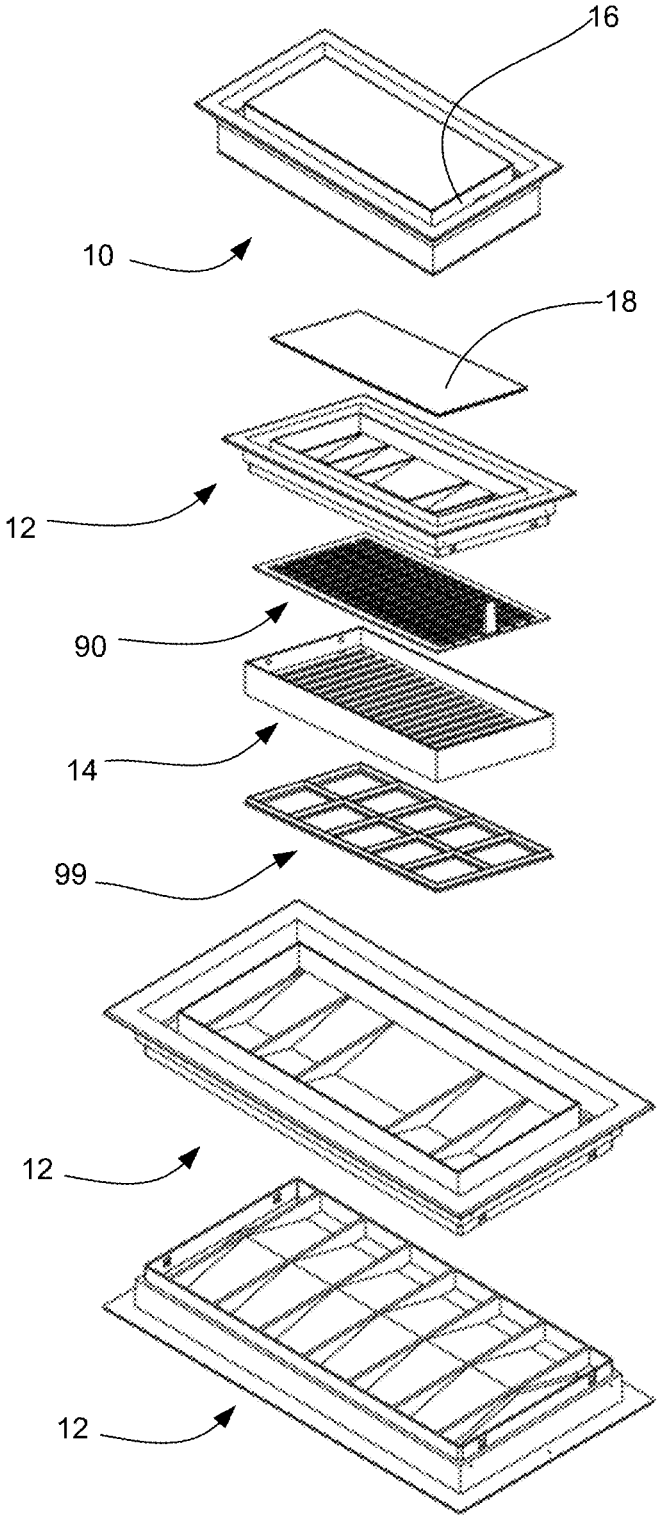
Figure 23:
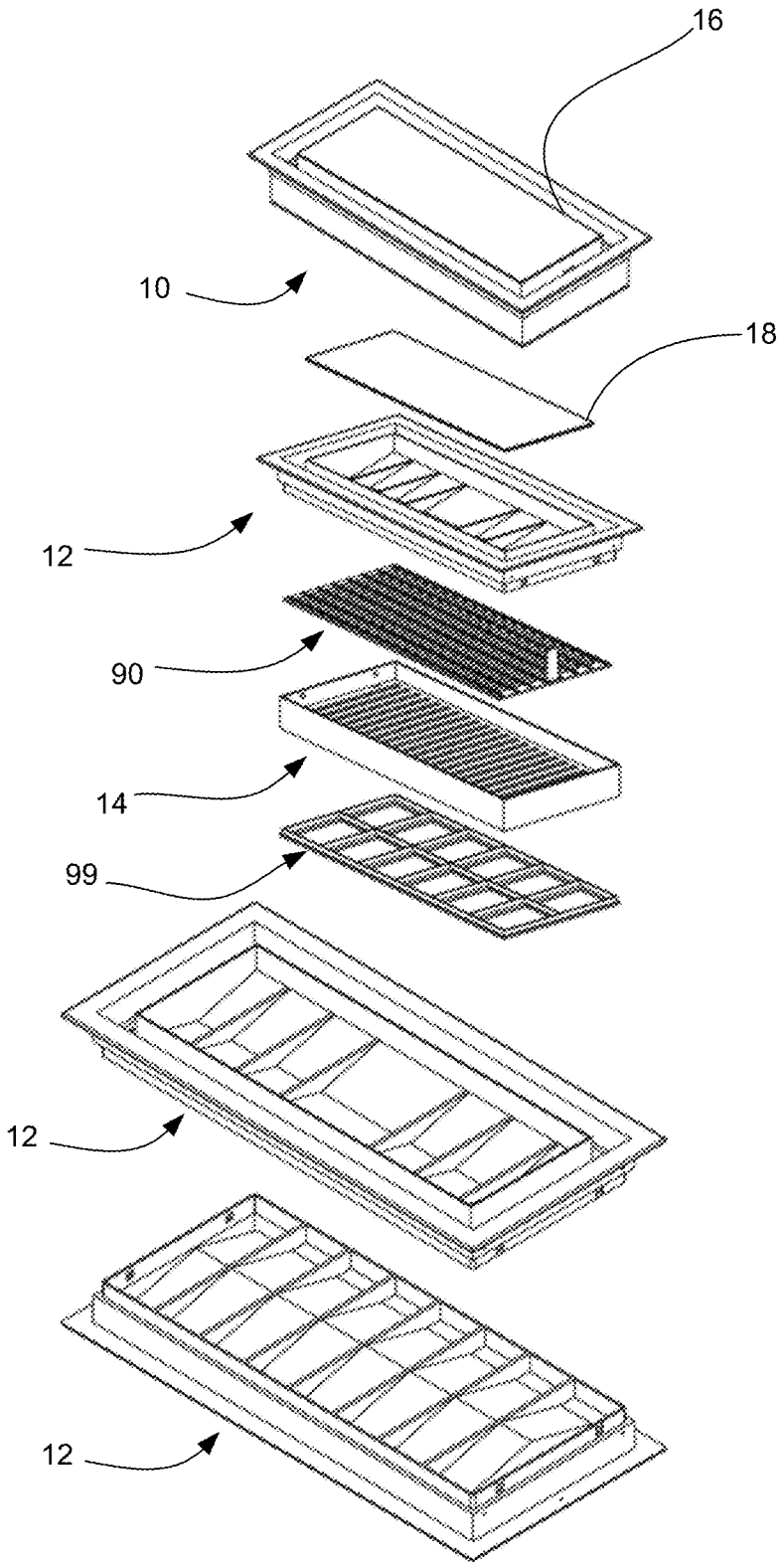

In one example, apertured grid 99 is removably attached to the bottom opening 77*b* such that a cavity 102 is defined between the grid 99 and the apertured bottom wall 78, as can be seen in FIGS. 10-12. The grid 99 comprises a plurality of apertures 100, and may be configured to frictionally fit within the bottom opening 77*b*. The cavity 102 may receive an air filter 103 which is retained therein by the grid 99. In one example, grid 99 is removably attached to the bottom opening 77*b*, as such, the air filter 103 can be replaced periodically as needed.

As can be seen in FIGS. 13-23, the register system 10 may include components 12, 14, 16, 18, 19, 90, 99 with differing dimensions.

In addition, damper box 14 and substrate tray 16 are dimensioned to fit inside industry standard vent openings. Accordingly, when flush mount register system 10 is fully assembled, substrate tray 16 is capable of supporting similar forces imposed on flooring 12, such as those from furniture, objects, or people.

In another implementation, damper box 14 includes a single damper or any number of dampers, depending on the size of the opening, application, desired results, and user preferences.

In another implementation, while the system 10 is primarily meant to be installed at the same time as the flooring material 18, it can be modified to allow use of leftover flooring such that the finished product matches the existing flooring material 18.

In another implementation, substrate tray 16 is removably secured to damper box 14.

Those skilled in the art will recognize that the dimensions shown in the drawings are exemplary in nature only, as these dimensions are applicable in one exemplary implementation e.g. for 4"×10" vent openings, and therefore can vary depending on the requirements for a particular application, desired results, and user preferences. For example, flush mount register system 10 may be dimensioned to fit any opening, accordingly exemplary sizes of flush mount register system 10 may be 2"×12" and 4"×12".

In another implementation, the system 10 is installed in a ceiling or a wall. Accordingly, substrate tray 16 may house ceiling tile or drywall.

In another implementation, each of the pair of second laterally extending walls 44, 46 of substrate tray 16 comprise at least one strut extending outwardly, wherein one end of the struts 52, 54 is secured to the first pair of laterally extending sidewalls 24, 26 of damper box 14.

The preceding detailed description of exemplary embodiments of the invention makes reference to the accompanying drawings, which show the exemplary embodiment by way of illustration. While these exemplary embodiments are described in sufficient detail to enable those skilled in the art to practice the invention, it should be understood that other embodiments may be realized and that logical and mechanical changes may be made. For example, the steps recited in any of the method or process claims may be executed in any order and are not limited to the order presented. Further, the present invention may be practiced using one or more servers, as necessary. Thus, the preceding detailed description is presented for purposes of illustration only and not of limitation, and the scope of the invention is defined by the preceding description, and with respect to the attached claims.

The invention claimed is:

1. A flush mount register system comprising:

a register;

a damper box;

a substrate tray nested within the register via a plurality of struts; and having a continuous peripheral gap defined between the substrate tray and the register;

a damper slidably mounted on the damper box for controlling air flow volume through the damper box into the continuous peripheral gap;

wherein the substrate tray receives a substrate, and wherein the register rests on the damper box.

2. The flush mount register system of claim 1, wherein the register comprises a first pair of longitudinally extending sidewalls and a first pair of laterally extending sidewalls which are joined to form a rectangularly shaped structure with a register top opening and a register bottom opening, wherein the first pair of laterally extending sidewalls comprises two portions with a shoulder defined therebetween.

3. The flush mount register system of claim 2, wherein the substrate tray comprises a second pair of longitudinally extending sidewalls and a second pair of laterally extending sidewalls which are joined to form a rectangularly shaped structure with a base and a substrate tray opening, and wherein the plurality of struts are secured the first pair of longitudinally extending sidewalls at one end and to the second pair of longitudinally extending sidewalls.

4. The flush mount register system of claim 3, wherein the substrate is contained within the second pair of longitudinally extending sidewalls and the second pair of laterally extending sidewalls.

5. The flush mount register system of claim 4, wherein the damper box comprises a damper box top opening and a damper box bottom opening with an apertured bottom wall.

6. The flush mount register system of claim 5, wherein the damper comprises a plate with a first of plurality of apertures.

7. The flush mount register system of claim 6, wherein the apertured bottom wall comprises a second plurality of apertures.

8. The flush mount register system of claim 7, wherein the plate is slidable over the apertured bottom wall such that the first of plurality of apertures are at least aligned, partially aligned, or misaligned with the second plurality of apertures, thereby regulating the air flow volume into the damper box.

9. The flush mount register system of claim 3, wherein the base of the substrate tray comprises an air deflector for directing air towards the continuous peripheral gap, thereby increasing the air flow volume through the continuous peripheral gap.

10. The flush mount register system of claim 8, wherein the damper box and the substrate tray are coplanar, such that the substrate is flush with a surrounding flooring.

11. The flush mount register system of claim 8, further comprising an apertured grid is removably attached to the bottom opening such that a cavity is defined between the apertured grid and the damper box bottom opening.

12. The flush mount register system of claim 11, wherein an air filter is retained within the cavity.

13. The flush mount register system of claim 8, wherein the damper comprises a finger projecting from a top surface of the damper, the finger extending through the continuous peripheral gap, whereby a force is applied to the finger to cause the damper to linearly slide relative to the apertured bottom wall of the damper box.

14. A flush mount register system comprising:

a register;

a damper box comprising a top opening, a bottom opening and an apertured bottom wall adjacent to the bottom opening, and wherein the register rests on the damper box;

a substrate tray nested within the register, and having a continuous peripheral gap defined between the substrate tray and the register, and wherein the substrate tray receives a substrate;

a damper slidably mounted on the damper box for controlling air flow volume through the damper box into the continuous peripheral gap;

an apertured grid removably attached to the bottom opening of the damper box, such that a cavity is defined between the apertured grid and the bottom opening; and an air filter retained within the cavity.

15. The flush mount register system of claim 14, wherein the damper comprises a plate with a first of plurality of apertures.

16. The flush mount register system of claim 15, wherein the apertured bottom wall comprises a second plurality of apertures.

17. The flush mount register system of claim 16, wherein the plate is slidable over the apertured bottom wall such that the first of plurality of apertures are at least aligned, partially aligned, or misaligned with the second plurality of apertures, thereby regulating the air flow volume into the damper box.

18. The flush mount register system of claim 14, wherein the base of the substrate tray comprises an air deflector for directing air towards the continuous peripheral gap, thereby increasing the air flow volume through the continuous peripheral gap.

19. The flush mount register system of claim 14, wherein the damper comprises a finger projecting from a top surface of the damper, the finger extending through the continuous peripheral gap, whereby a force is applied to the finger to cause the damper to linearly slide relative to the apertured bottom wall of the damper box.

20. The flush mount register system of claim 14, wherein the substrate tray secured to interior walls of the register via at least one strut.

* * * * *